United States Patent [19]

Pearce

[11] Patent Number: 4,632,176

[45] Date of Patent: Dec. 30, 1986

[54] APPARATUS FOR CONTINUOUS STRIP CASTING OF ALUMINUM SHEET MATERIAL

[76] Inventor: Ronald A. Pearce, 2997 Pierson Way, Lakewood, Colo. 80215

[21] Appl. No.: 725,106

[22] Filed: Apr. 19, 1985

[51] Int. Cl.[4] ..... B22D 11/06

[52] U.S. Cl. ..... 164/481; 164/476; 164/431; 164/443; 164/485; 164/417

[58] Field of Search ..... 164/431, 481, 417, 476, 164/443, 485, 432; 148/2

[56] References Cited

U.S. PATENT DOCUMENTS

| | | | |
|---|---|---|---|
| 2,790,216 | 4/1957 | Hunter . | |
| 3,036,348 | 5/1962 | Hazelett et al. . | |
| 3,163,896 | 1/1965 | Rochester et al. | 164/481 |
| 3,933,193 | 1/1976 | Baker et al. . | |
| 4,190,103 | 2/1980 | Sivilotti et al. . | |
| 4,238,248 | 12/1980 | Gyongyos et al. . | |
| 4,341,259 | 7/1982 | Lauener | 164/417 X |
| 4,510,990 | 4/1985 | Artz et al. | 164/431 |

FOREIGN PATENT DOCUMENTS

| | | | |
|---|---|---|---|
| 57-72755 | 5/1982 | Japan | 164/431 |
| 58-112638 | 7/1983 | Japan | 164/431 |
| 7801735 | 9/1978 | Netherlands | 164/431 |

*Primary Examiner*—Kuang Y. Lin

*Attorney, Agent, or Firm*—Klaas & Law

[57] ABSTRACT

Apparatus for continuously forming a continuous strip of aluminum sheet material using a belt caster for forming a continuous strip of aluminum sheet material and a roll caster for immediately reducing the thickness of the continuous strip of aluminum sheet material wherein the continuous loop belt means used in the belt caster are driven by the rolls of said roll caster.

36 Claims, 5 Drawing Figures

APPARATUS FOR CONTINUOUS STRIP CASTING OF ALUMINUM SHEET MATERIAL

FIELD OF THE INVENTION

This invention relates to apparatus for the continuous strip casting of aluminum sheet material and, more particularly, to a belt-type caster apparatus which may be used independently to convert molten aluminum material into a continuous strip of aluminum sheet material and in combination with a roll-type caster apparatus to reduce the thickness of the formed continuous strip of aluminum sheet material.

BACKGROUND OF THE INVENTION

There are several types of prior art apparatus for continuous strip casting of aluminum sheet material. A first type is a roll caster such as that disclosed in U.S. Pat. No. 2,790,216 to J. L. Hunter which comprises flowing molten aluminum into the nip between chill rollers which function to solidify the molten aluminum and form it into a continuous strip. A second type is known as a block caster such as that disclosed in U.S. Pat. No. 4,238,248 to Gyongyos comprising continuously casting an aluminum melt into strip form and hot rolling the continuous strip at a casting speed in a temperature range of between 300 degrees C. and the non-equilibrium solidus temperature of the melt with a total reduction in thickness in excess of 70% and coiling the hot strip and allowing it to cool. A third type is a belt caster such as that disclosed in U.S. Pat. No. 3,933,193 to Baker et al. which comprises feeding a continuous supply of molten aluminum material between moving upper and lower continuous belts and cooling the material while between the moving upper and lower belts to form a continuous strip of aluminum sheet material. Other variations of belt-type casters are disclosed in U.S. Pat. No. 3,036,348 to Hazelett et al. and U.S. Pat. No. 4,190,103 to Silvilotti et al.

Each of the foregoing apparatus and processes have certain advantages and disadvantages. For example, a roll-type caster operates at low speed whereas block and belt casters can accommodate high alloy and harder metals.

SUMMARY OF THE INVENTION

This invention provides a belt-type caster for forming a continuous strip of aluminum sheet material and a roll-type caster for immediately reducing the thickness of the continuous strip of aluminum sheet material wherein the continuous loop belt means used in the belt-type caster are driven by the rollers in the conventional Hunter horizontal cast roll-type caster.

In the preferred embodiment of the invention, the belt-type caster comprises an upper and a lower roll means, an upper and a lower guide arcuate guide means, an upper and a lower continuous loop belt means journalled around associated rolls and arcuate guide means and having opposed spaced apart straight sections each extending between the roll means and the arcuate guide means, dam means are provided to cooperate with the straight sections of the continuous loop belt means to form a rectangular cavity between the straight portions of the upper and lower continuous loop belt means. Means are provided for moving the upper and lower continuous loop belt means. The dam means comprise a plurality of short length individual dam means connected to a sprocket chain with means being provided to connect each individual dam means with one of the continuous loop belt means so that the dam means provide an outwardly directed force to each side of one of the continuous loop belt means to remove any buckling therein. A supply of molten aluminum material is fed between the upper and lower continuous loop belt means adjacent to the upper and lower arcuate guide means for movement with the upper and lower continuous loop belt means and the dam means through the straight portions. Cooling means associated with the straight portions of the upper and lower continuous loop belt means functions to cool the molten aluminum material to form a continuous strip of aluminum sheet material. In a preferred arrangement, the upper and lower rolls around which the upper and lower continuous loop belt means are journalled also form a roll-type caster so that the continuous strip of aluminum sheet material form by the belt-type caster moves with the upper and lower continuous loop belt means between the nip between the upper and lower rolls so that the thickness of the continuous strip of aluminum sheet material is reduced.

The cooling system in the preferred embodiment comprises a plurality of rows of high pressure and high velocity cooling water spray means each of which extends across the width of each belt and which rows are spaced apart in the direction of movement of the belt means. Low pressure plenum means are located between adjacent rows of the high pressure and high velocity cooling water spray means. Each row of the high pressure and high velocity cooling water spray means is mounted for linear movement toward and away from an associated belt means. A low pressure plenum removes the heated water with means being provided to control the rate of heated water removed out of the low pressure plenum means to create a vacuum on the associated one of the continuous loop belt means. This allows for maximum heat extraction and helps the continuous loop belt means to conform to the profile of the rows of high pressure and high velocity cooling water sprays defining a mold cavity and to reduce water leakage. Also, hydrostatic means provide bearing surfaces on the arcuate guide means and which hydrostatic means may include steam to preheat the upper and lower continuous loop belt means. In addition to the foregoing, the preferred embodiment has means associated with the upper and lower continuous loop belt means and the dam means to compensate for the shrinkage of the molten aluminum material as it cools, during passage through the straight portions.

It is an object of this invention to provide a belt-type caster with moving upper and lower continuous loop belt means cooperating with moving side dam means to form a rectangular cavity in combination with cooling means for the upper and lower continuous loop belt means adjacent to the rectangular cavity so as to convert a continuous supply of molten aluminum material fed between the upper and lower continuous loop belt means into a continuous strip of aluminum sheet material during passage through the rectangular cavity.

It is another object of this invention to provide a combination of a belt-type caster and a roll-type caster wherein the continuous loop belt means of the belt-type casters are driven by the rollers of the roll-type caster so that the continuous strip of aluminum sheet material formed by the belt-type caster is immediately fed into the nip between the rollers of the roll-type caster to be reduced in thickness.

Other objects and advantages of the invention will be apparent from the following more particular description of the preferred embodiments as illustrated in the accompanying drawings in which like reference characters refer to the same part throughout the various views. The drawings are not necessarily to scale, emphasis instead being placed upon illustrating the principles of the invention.

DETAILED DESCRIPTION OF THE INVENTION

Figure 1:
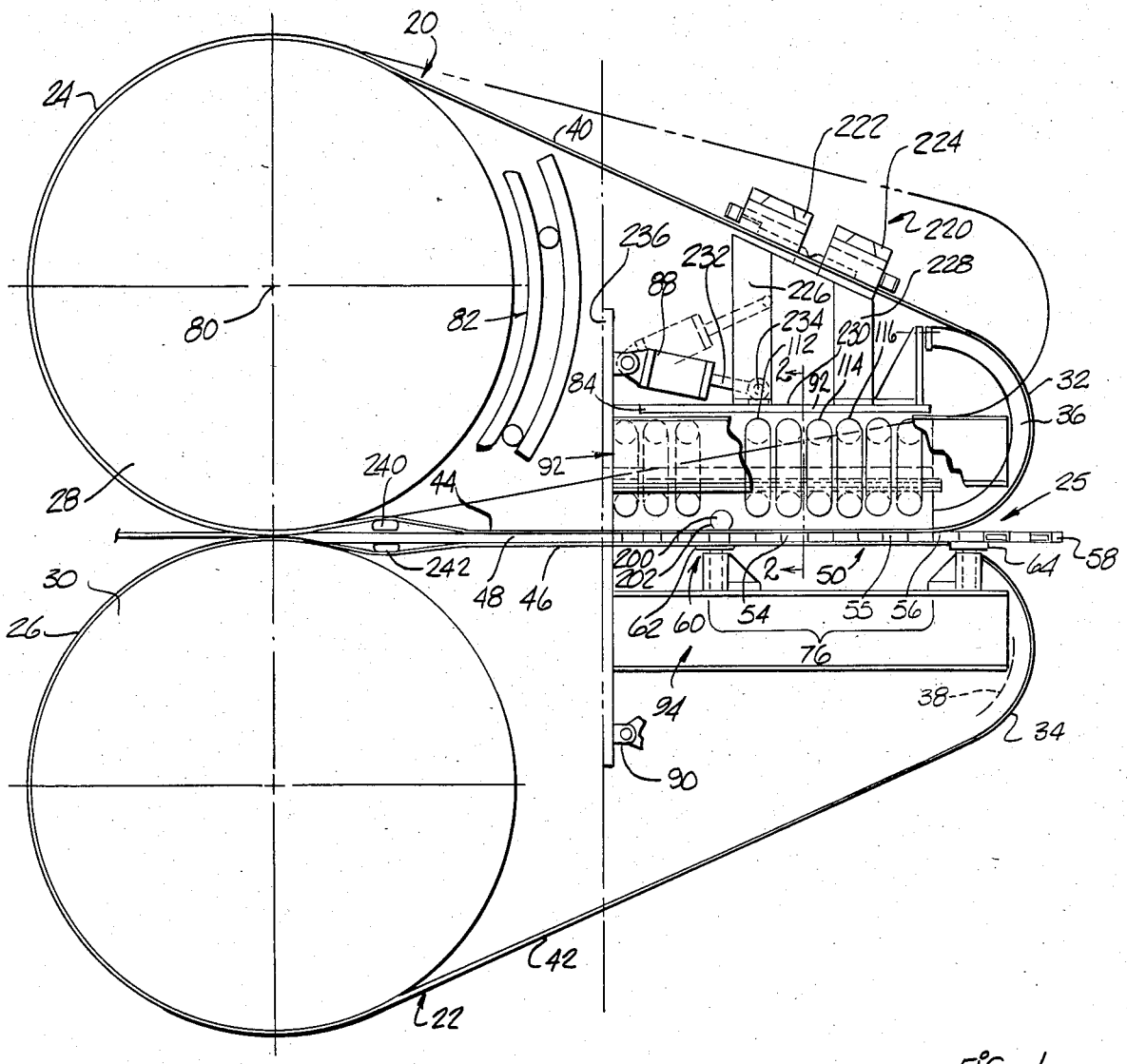
FIG. 1 is a schematic, side elevational view of the apparatus of the present invention showing a portion of a conventional roll-type horizontal caster apparatus in combination with a belt-type caster apparatus.

In general, as shown in FIG. 1, the invention comprises a pair of continuous loop steel belt means 20, 22 having front end portions 24, 26 mounted on and driven by a pair of roll means 28, 30 of a conventional roll-type caster. Rear end belt portions 32, 34 are supported by semi-circular guide means 36, 38. Outer intermediate belt portions 40, 42 extend inwardly and rearwardly between roll means 28, 30 and guide shoe means 36, 38. Inner intermediate elongated straight portions 44, 46 extend forwardly between guide means 36, 38 and roll means 28, 30 in spaced, generally parallel relationship to define an elongated cavity 48 of rectangular, cross-sectional configuration therebetween. As explained below, the cavity 48 will have a slight taper with the smallest portion adjacent to the rolls 28 and 30.

Figure 3:
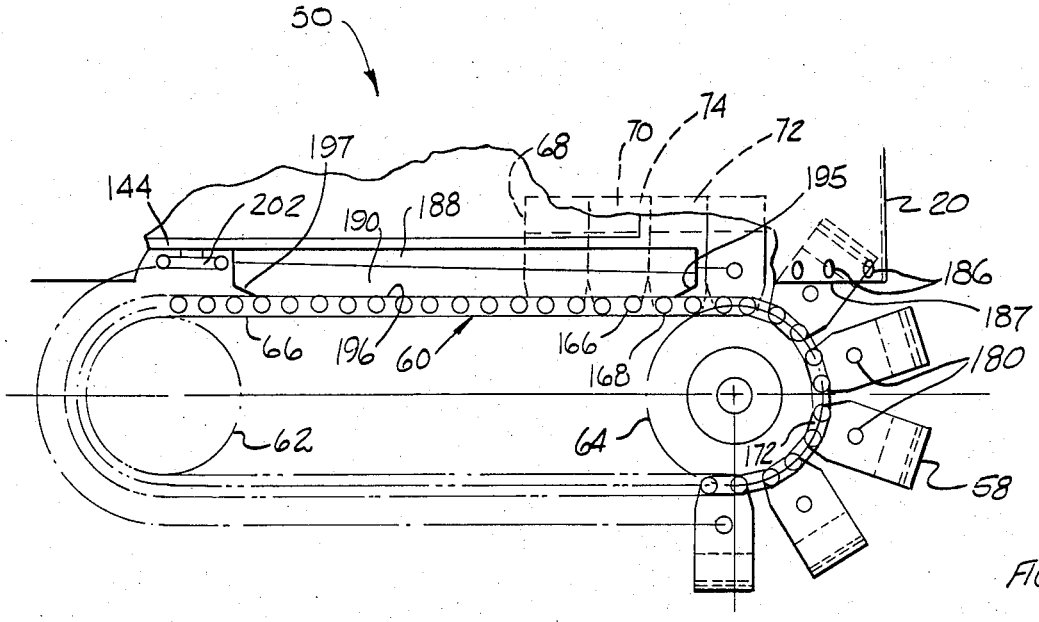
FIG. 3 is a partial top plan, view with parts in section of the dam means.

Dam means 50, 52 are located on opposite sides of the cavity 48 for confining the molten material therebetween. The dam means comprises a plurality of individual short length dam members 54, 55, 56, 58, etc., FIG. 1 mounted on a continuous loop chain means 60 for movement about sprocket means 62, 64 to provide an innermost intermediate length portion 66, FIG. 3, extending approximately between the vertical axes of rotation of sprocket means 62, 64, along which adjacent ones of the individual dam members 68, 70, 72, FIG. 3 are held in abutting side-by-side relationship to form a continuous side surface dam means 74 extending along a forming area 76, FIG. 1. The individual dam members 68, 70, 72 are in contact with the upper and lower straight belt portions 44 and 46 during movement through the distance defined by the forming area portion 76 of the elongated cavity 48. Lower belt means 22 is driven by drive roll means 30 in a fixed path. Upper roll means 28 is driven by the lower roll means 30 so as to drive the upper belt means 20. The central axis 80 of the upper roll means 28 provides a pivot axis whereby the upper belt means 20 and associated apparatus including guide means 36 may be upwardly and downwardly pivotally displaced relative to the lower belt means 22 between a lowermost operating position shown by solid lines in FIG. 1 and an uppermost non-operating position shown by dotted lines in FIG. 1. Guide and support means 82 in the form of an arcuate track and roller means are provided in concentric relationship to pivot 80. Guide means 36, 38 are mounted on slidably movable support structure means 84 connected to pivotally mounted cylinder means 88, 90 for causing movement of the guide means between a non-tension and a tension position whereby the tension in the belt means may be varied.

Figure 2:
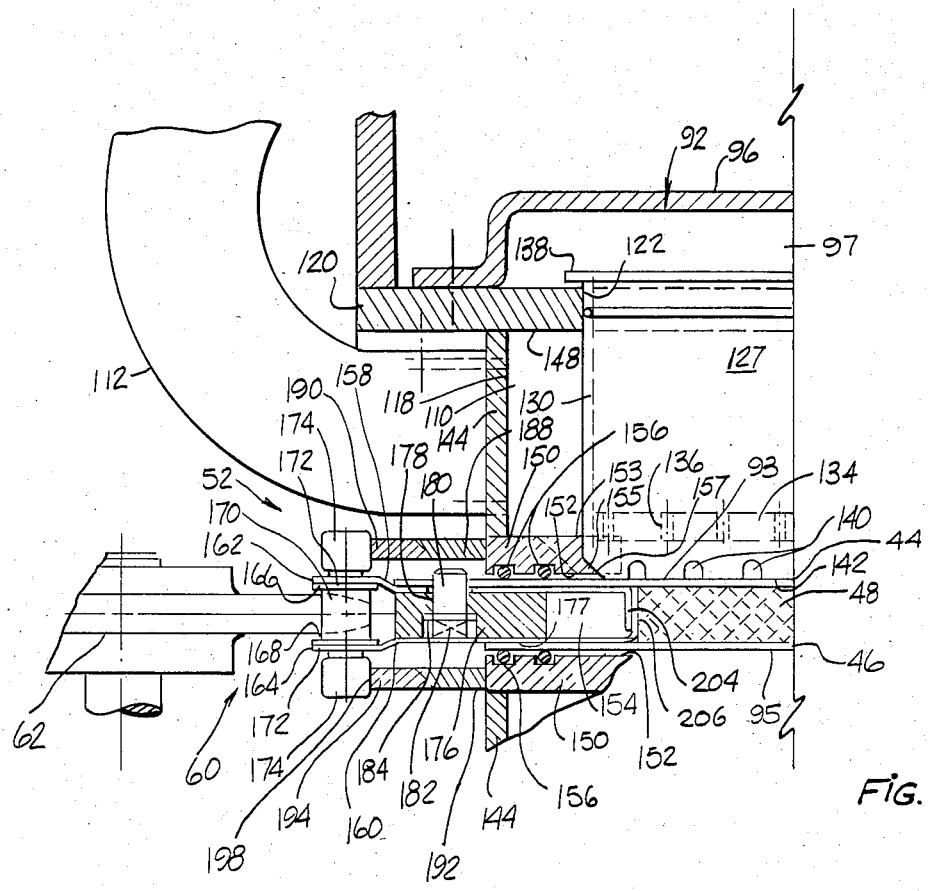
FIG. 2 is a partial, cross-sectional view taken along line 2—2 in FIG. 1.

Cooling means 92, 94 are associated with the inner surfaces 93, 95, FIG. 2, of each of the belt means in the forming area 76. Each of the cooling means comprises a high pressure plenum means 96 having a coolant inlet chamber 97 for receiving cooling water at relatively high pressures (e.g. 20 to 40 psi), a plurality of individual rectangular-shape conduit (channel) means such as 98, 100, 102, etc., FIGS. 2 and 4, for enabling flow of water from high pressure plenum means 96 to the inner surface of the belt means and across the belt surface with return of heated water through return conduit (channel) means 104, 106, 108, etc. to low pressure water plenum means 110, having a coolant outlet chamber 118, FIG. 2, and then to exhaust conduit means 112, 114, 116, etc.

The cooling means is divided into the high pressure plenum 96 and the low pressure plenum 110 by a rectangular-shape plate 120 having a plurality of transverse slots 122 formed therein. As illustrated in the drawings, the high pressure plenum and the low pressure plenum extend across the width of the belt and for substantially the complete length of the forming area 76. The individual conduit means 98, 100 and 102 are mounted in the slots 122 for linear sliding movement toward and away from an associated continuous loop belt means 20 and 22. Sealing gaskets 124 are seated in grooves 126 to form a seal between the individual conduit means 98, 100 and 102 and the plate 120. Each of the individual conduit means 98, 100 and 102 comprises a generally rectangularly shaped member 127 having longitudinally spaced parallel side walls 128 and transversely spaced parallel opposite end walls 130 with an open end 132 of a central rectangular passage 133 in fluid communication with the chamber 97 of high pressure plenum 96. A bar 134, extends across passage 133 and is secured in a fluid tight relationship to the inner surfaces of the side walls 128 and end walls 130. The bar 134 is provided with a plurality of transversely spaced nozzle-type apertures 136 and the bar is spaced a predetermined distance from the other open end 137 of the side walls 128 and end walls 130 and located adjacent to an associated continuous loop belt means 20 or 22. An edge flange 138 secured to each side of the upper end of the side walls 128 and end walls 130 limits the linear movement of the member 127 toward the continuous loop belt means 20 or 22. A plurality of laterally spaced cross openings 140 are provided in the side walls 128 adjacent to the edge surfaces 142 thereof to provide for passageways through which water flowing through the apertures 136, as described below, may escape into return channel means 104, 106, 108 and return plenum chambers 118.

The low pressure plenum means 110 comprises a pair of opposed side walls 144 extending along the side edge portions of the belt means and end walls 146 secured to the surface 148 of the support plate 120. A plate 150 is secured to the side walls 144 and end walls 146 so that an outer surface 152 thereof is adjacent to the side edge portions of an associated continuous loop belt means 20 or 22. The plate 150 each side of the belt means is provided with a plurality of slots 153 having a chamferred bottom surface 155 for slidably receiving and supporting the bottom side surfaces 157 of the sidewalls 128 and the end walls 130. This holds the members 127 in position. The plate 150 is provided with a plurality of openings 154 FIGS. 2 and 4, beneath and between inlet channel means 127 so that a portion of the cooling water flowing out of the orifices 136 onto the associated continuous loop belt means 20 or 22 will absorb heat from the molten material and pass laterally outwardly through the side edge openings 154 into the low pressure plenum 110. A plurality of exhaust conduits, such as 112, 114 and 116 are connected to the side wall 144 and are connected at their ends (not shown) to suitable pump means so as to draw the water from the low pressure plenum means 110. In this way, the heated water is induced to flow through channels 104, 106, 108 and the openings 154 into the low pressure plenum means 110. The pump means function at a rate sufficient to create a vacuum so that the continuous loop belt means 20 and 22 are urged toward the adjacent side surfaces of the slab of metallic material 155, FIG. 2, by edges 142 of the members 127 because of the pressure differential between the relatively high pressure inlet coolant acting against members 127 and the relatively low pressure outlet coolant while the coolant is rapidly removed without significant leakage because of the low pressure condition. As illustrated in FIG. 2, the upper and lower plates 150 are provided with sealing gaskets 156 which function to keep the coolant water confined between the chambers 118 and the associated continuous loop belt means 20 or 22.

The dam means is illustrated more specifically in FIGS. 2 and 3 wherein each of the individual dam members 68, 70, 72 comprise an upper L-shaped member 158 and a lower L-shaped member 160. Adjacent to the edges 162 and 164, the L-shaped members 158 and 160 are provided with a pair of spaced apart openings 166 and 168 which receive rods 170 associated with the links 172 of the continuous loop chain means 60. This mounting of the L-shaped members 158 and 160 functions to keep the individual dam members 68, 70, 72 in side-by-side abutting relationship as they move through the forming area 76. An upper rotatable cam follower 174 and a lower rotatable cam follower are mounted on the opposite ends of each rod 170 for a purpose to be described below.

A support block 176 is located between the upper L-shaped member 158 and the lower L-shaped member 160 and is located to provided supporting surfaces 177 for the edge portions of the continuous loop belt means 20 and 22 engaging the side surfaces of members 158, 160 to ensure sealing engagement of the continuous loop belt means and the sealing gaskets 156. Each support block 176 is provided with a generally cylindrical opening 178 in which is located a pin 180 which is mounted for reciprocal movement in the cylindrical opening 178 and is normally urged outwardly by spring means 182. A shoulder 184 on each pin 180 retains the pin 180 in the cylindrical opening 178. The upper continuous loop belt means 20 is provided with a plurality of openings 186 adjacent the opposite side edges 187 thereof. Although only one side of the apparatus is illustrated in FIGS. 2 and 3, it is understood that the opposite side of the continuous loop belt means 20 is provided with similar structures and functions as described in relation to FIGS. 2 and 3. The openings 186 are spaced at locations so that as the continuous loop belt means moves around the arcuate guide 32, the pins 180 move through the openings 186 and remain therein during passage of the continuous loop belt means through the forming area 76.

A cooperating pair of upper cam blocks 188 and 190 are mounted on the side wall 144 of the upper chamber 118 and a cooperating pair of lower cam blocks 192 and 194 are mounted on the side wall 144 of the upper and lower chamber 118. The upper cam blocks 188 and 190 are slidably adjustable relative to each other so as to move the bearing surface 196, FIG. 3, of the cam block 190 toward or away from the side wall 144 of the upper chamber 118. Similarly, the lower cam blocks 192 and 194 are slidably adjustable relative to each other so as to move the bearing surface 198 of the cam block 194 toward or away from the side wall 144 of the lower chamber 118. As illustrated in FIG. 3, the leading and trailing portions 195, 197 of the bearing surface 196 are inclined. Although not shown, the bearing surface 198 is similarly structured. The cam blocks 188 and 190 and 192 and 194 function to apply outwardly directed forces to the edges of upper continuous loop belt means 20 as as to insure that there are no buckles in the upper continuous loop belt means 20 as it is moved into contact and travels along with the molten material. This is to ensure intimate flat surface belt contact with the molten material. Thus, after the pins 180 have moved through the openings 186, the cam followers 174 contact the inclined lead end portions 195 of the bearing surfaces 196 and 198. The upper cam blocks 188 and 190 and the lower cam blocks 192 and 194 have been adjusted to space the bearing surfaces 196 and 198 a distance from the associated side wall 144 so that, when the cam followers 174 are in contact with the bearing surfaces 196 and 198, sufficient force is being applied to the upper continuous loop belt means 20 so as to stretch the continuous loop belt means 20 so that there are no buckles therein. A wheel 200 FIGS. 1 & 3, with a horizontal axis of rotation is rotatably mounted at a location spaced a short distance from the end of the cam block 188. The outer surface 202 of the wheel 200 is located so as to contact each pin 180 and move it downwardly so as to disengage each pin 180 from its associated opening 186.

The lip portion 204, FIG. 2, on the flexible cantilevered end portion of the upper L-shaped member 158 is nested within the lip portion 206 on the flexible cantilevered end portion of the lower L-shaped member 160 so that the outer surface of each lip portion 206 is in contact with the side edge surface of the molten material. The lip portions 204 and 206 are dimensioned so as to permit limited relative movement of the upper L-shaped member 158 and the lower L-shaped member 160 toward each other. This structure cooperates with the upper and lower continuous loop belt means 20 and 22, as described below, to accommodate for the shrinkage of the molten material as it is cooled during passage through the forming area 76.

Figure 4:
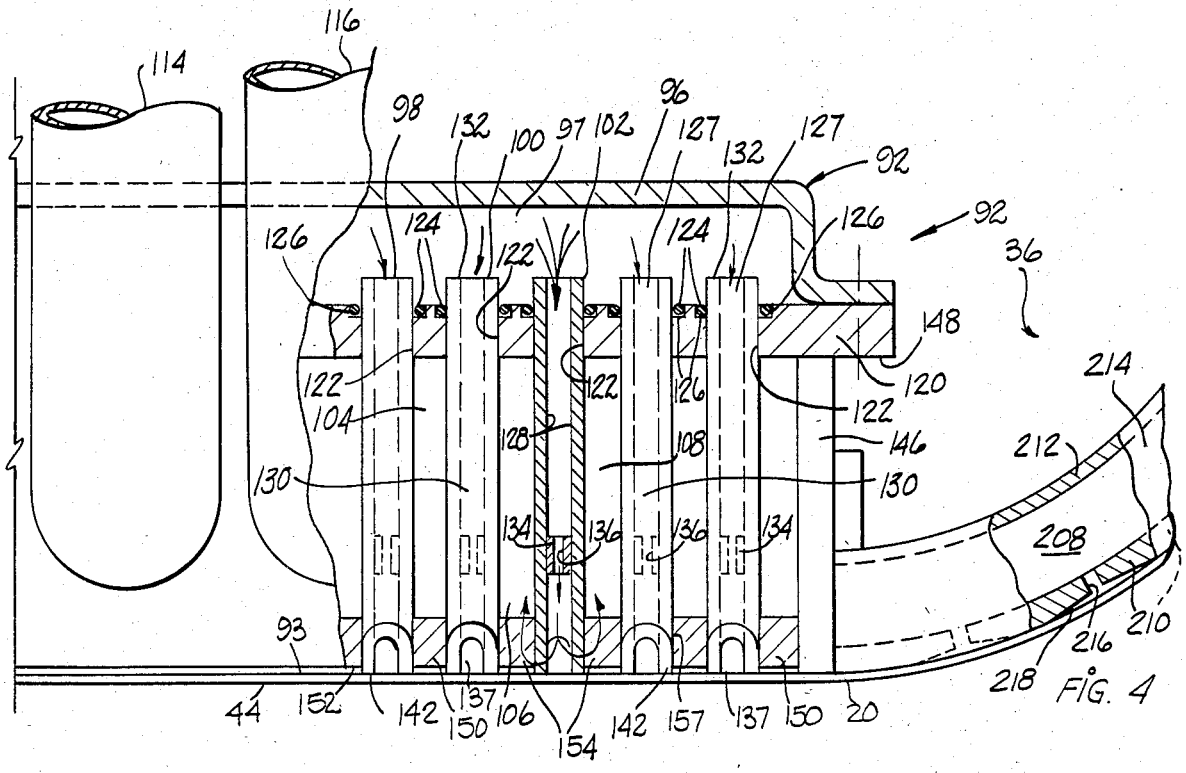
FIG. 4 is an enlarged, partial cross-sectional view illustrating the arcuate guide means and the cooling means.

As described above, the upper and lower continuous loop belt means 20 and 22 are driven by conventional drive means associated with the upper and lower rolls 28 and 30 and the rear end portions 32 and 24 are supported by semi-circular guide means 36 and 38. The upper guide means 36 is illustrated in FIG. 4 and comprises a hollow member 208 having concentric outer and inner walls 210 and 212 closed by appropriate end walls 214. The outer wall 210 is provided with a plurality of openings 216 which are spaced apart across the width of the hollow member 208 and along the length thereof in the direction of movement of the continuous loop belt means 20. The openings 216 are associated with tapered recesses 218 in the outer surface of the outer wall 210. Sealing means (not shown) are provided along each outer edge of the outer wall 210 so as to provide a seal between the continuous loop belt means 20 and the outer wall 210. Steam is fed into the hollow member 208 and moves through the openings 216 and recesses 218 to provide a low friction hydrostatic bearing surface for the continuous loop belt means 20 and to raise the temperature of the continuous loop belt means 20 prior to its contact with the molten material as described below. While only the upper continuous loop belt means 20 and the associated structures have been discussed, it is understood that similar structures are associated throughout relative to the lower continuous loop belt means 22.

Figure 5:
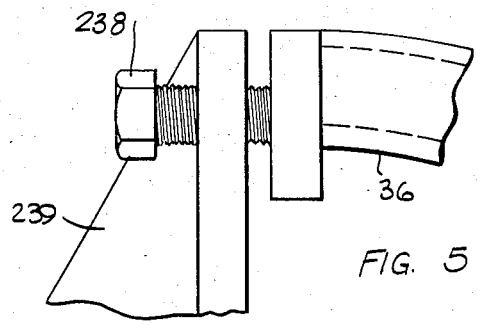
FIG. 5 is an enlarged partial view of alignment means for guide means shown in FIG. 1.

In FIG. 1, there is illustrated a belt welding fixture 220 comprising two adjacent members 222 and 224 each of which have means for holding an end of the continuous loop belt means 20 in a fixed location so that the ends of the continuous loop belt means 20 are positioned relative to each other so that they may be welded together. After the weld has been completed, the same fixture is used to finish grind the weld. The members 222 and 224 are supported by beams 226 and 228 which are secured to a slidable support means 230 which are operatively connected to a piston 232 by clevis means 234. The piston 232 moves in and out of a hydraulic cylinder 88 which is secured to a fixed support 236. The guide means 36 is connected to the slidable support means 230 so that movement of the piston 232 out of the hydraulic cylinder 88 moves the guide means 36 to apply tension to the upper continuous loop belt means 20. As illustrated in FIG. 5, a plurality of adjusting screws 238 on a bracket 239 are used to adjust the alignment of the guide means 36 with the continuous loop belt means 20. As stated above, similar structures are associated with the lower continuous belt means 22.

The operation will be described generally with the apparatus in assembled relationship and the various moving parts in operational relationship. That is, the continuous loop belt means 20 and 22 have been welded together and aligned, the rolls 28 and 30 are rotating to drive the continuous loop belt means 20 and 22, water is being supplied to the high pressure plenum 96 and being withdrawn through the low pressure plenum 110 and the bearing surfaces 196 and 198 have been located to place the proper tension across the width of the upper continuous loop belt means 20. Steam is being fed into the hollow member 208 to form a hydrostatic bearing surface for the continuous loop belt means 20 and to heat such belt means 20 prior to its movement into contact with the molten material.

Molten material 25, such as aluminum, is fed into the forming area between the upper and lower continuous loop belt means 20 and 22 as they reach adjacent portions of the upper and lower arcuate guide means 36, 38 in a conventional manner. Then, upper and lower opposite surfaces of the continuous loop belt means 20 and 22 move into engagement with the upper and lower surfaces of the individual dam members 68, 70 and 72. The spring-urged piston 180 projecting from each individual dam member enters into an associated opening 186 in the upper continuous loop belt means 20 so that the dam means moves with and is driven by the upper continuous loop belt means 20. The dam members are moved outwardly by cam followers 174 in engagement with the bearing surfaces 196 and 198 so that the proper tension is placed across the width of the upper continuous loop belt means to remove any buckles therefrom. The pressure of the cooling water in the high pressure plenum is controlled so that the pressure on the bars 134 is in an amount to exert the desired pressure on the continuous loop belt means 20 and 25 so as to control the thickness of the molten aluminum located in the cavity formed by the upper and lower continuous belt means 20 and 22 and the dam members 68, 70, 72 and 74. Also, the rate at which the heated water withdrawn from the low pressure plenum 110 by the pump means is controlled so as to create a slight vacuum to assist in creating a sufficient pressure differential to hold the continuous loop belt means 20 and 22 in a desired continuous surface contacting relationship with the upper and lower slab surfaces by force exerted through the members 127 and so that the cooling water passing through the apertures 136 moves into contact with the adjacent surfaces of the continuous loop belt means 20 and 22 at relatively high velocity and is removed in a most efficient manner to effect cooling of the molten aluminum material. The pressure on the water in the high pressure plenum 96 is sufficient to move the water through the apertures 136 by a venturi effect at a relatively high velocity. It is understood that metals other than aluminum may be processed with the apparatus of this invention.

During passage of the molten material through the elongated forming area 76, the surfaces of the molten aluminum material are continually cooled by cooling water discharged under high pressure jet conditions across the entire inner surfaces of the continuous loop belt means. As the molten material cools there is some shrinkage so that the thickness of the material gradually decreases. The controlled pressures of the high pressure plenum 96 and the low pressure plenum 110 function to move the upper continuous belt means 20 and the lower continuous belt means 22 relative to each other to accommodate this shrinkage and keep the upper and lower continuous loop belt means 20 and 22 in contact with the associated surfaces of the aluminum. Since the weight of the slab material is usually sufficient to keep the lower surface of the material in full contact with the upper surface of the lower belt means, the apparatus may be constructed and arranged to only force the upper belt means downwardly toward the lower belt means to provide the aforedescribed relative movement between the belt means. Also, as described above, the L-shaped members 158 and 160 are also permitted to move toward each other to accommodate this shrinkage. As the individual dam means reach the end of the forming area 76, the wheel 200 contacts and depresses the piston 180 so that the upper continuous loop belt means 20 is disengaged from the individual dam members. The formed continuous strip of aluminum sheet material leaves the forming area 76 of the belt means caster and moves with the continuous loop belt 20 and 22 toward the rolls 28 and 30. If necessary, lubricating wick means 240 and 242 are provided to lubricate the upper and lower of surfaces of the continuous strip of aluminum just prior to entering the nip area between roll means 28, 30 whereat the thickness of the hot continuous strip of aluminum sheet material is reduced by a suitable amount by a hot rolling pressure and then discharged for further processing in a conventional manner. The temperature of any lubricating means must be such that the temperature of the strip is not cooled below the rolling temperature.

In the preferred embodiment of the invention, the continuous strip of aluminum leaving the forming area 76 has a width of about 60 inches and a thickness of about 0.280 inches. To obtain this, molten aluminum material is deposited between the upper and lower continuous loop belt means 20 and 22 at the rate of about 300 to 500 lbs./min. and at a temperature of about 1100 to 1200 degrees F. The width between opposed individual dam members at the beginning of the forming area is about 63 inches and the distance between the upper and lower continuous loop belt means 20 and 22 at the beginning of the forming area 76 is about 0.410 inches. The continuous loop belt means 20 and 22 move at a rate of about 12 ft./min. The pressure of the cooling water in the high pressure plenum is about 20 psi and the velocity of the water as it exits the apertures 136 is about 0.08 cu.ft/min./aperture. The pump means extracts heated water from the low pressure plenum at a rate to have a pressure of about 1 to 5 psi below atmospheric on the associated continuous loop belt means 20 and 22 to facilitate rapid removal of water without significant leakage along the edges of the belt means. The continuous strip of aluminum is fed into the nip between the rolls 28 and 30 and exits therefrom at a thickness of about 0.280 inches and at the rate of about 17.5 ft/min. At these flow rates the mold cavity can be around 9 inches long. The strip should be above 900 degrees F. at the entry to the rolls.

The illustrative embodiment of the invention may be variously modified for adaption to various apparatus and conditions of operation to achieve various results. Some of the features of this invention are alternative and may be selectively utilized only as necessary or desirable for under particular circumstances and conditions. Thus, it is intended that the appended claims be construed to include various alternative and modified constructions and arrangements except insofar as limited by the prior art.

What is claimed is:

1. Apparatus for casting a continuous strip of metallic sheet material having a rectangular, cross-sectional configuration defined by an upper flat surface, a lower flat surface and opposed side edge surfaces comprising:

an upper roll means and a lower roll means of a roll caster machine mounted in vertically spaced juxtaposition to define a thickness reducing gap therebetween and being rotatable relative to one another to enable a continuous strip of cast aluminum sheet material to be drawn therethrough and reduced in thickness while passing therethrough;

an upper arcuate guide means and a lower arcuate guide means mounted in vertically spaced juxtaposition on a support frame attached to said roll caster machine and being located upstream of said upper roll means and said lower roll means;

an upper continuous loop belt means operatively associated with and extending around said upper roll means and extending between said upper roll means and said upper arcuate guide means and being movable relative thereto and having a lower elongated straight horizontal portion extending between said upper roll means and said upper arcuate guide means and being movable toward said upper roll means and said lower roll means;

a lower continuous loop belt means operatively associated with and extending around said lower roll means and extending between said lower roll means and said lower arcuate guide means and being movable relative thereto and having an upper elongated straight horizontal portion extending between said lower roll means and said lower arcuate guide means and being movable toward said upper roll means and said lower roll means and being spaced a distance from said lower elongated straight portion of said upper continuous loop belt means to provide an elongated channel therebetween having an outlet opening at said thickness reducing gap between said upper roll means and said lower roll means and an inlet opening between said upper arcuate guide means and said lower arcuate guide means;

dam means located adjacent opposite side edge portions of each of said continuous loop belt means at least at the beginning of said straight horizontal portion for forming a rectangular elongated forming cavity between said straight horizontal portion of said upper belt means and said straight horizontal portion of said lower belt means;

means for continuously rotating said upper roll means and said lower roll means and for continuously moving said upper belt means and said lower belt means and for continuously moving said dam means;

means for continuously feeding a supply of molten aluminum material into said inlet opening between said upper belt means and said lower belt means adjacent to said upper and lower arcuate guide means and transporting the aluminum material to said thickness reducing gap between said upper roll means and said lower roll means through said elongated forming cavity and said elongated channel; and cooling means associated with each of said upper elongated straight portion of said upper continuous loop belt means and said lower elongated straight portion of said lower continuous loop belt means for cooling said molten aluminum material to form a continuous strip of cast aluminum sheet material to be drawn between said upper roll means and said lower roll means.

2. The invention as defined in claim 1 wherein said dam means has a length substantially coextensive with the length of said cooling means; and means for moving said dam means substantially in synchronism with said upper belt means and said lower belt means.

3. The invention as defined in claim 2 wherein each of said dam means comprises:

a pair of spaced apart sprocket means movably supporting a continuous loop chain means for movement in a continuous path including an elongated straight path portion extending generally parallel and adjacent the side edge portions of said straight portions of said upper and lower continuous loop belt means;

a plurality of relatively short length individual dam members connected to and carried with said chain means for movement in adjacent abutting engagement with one another along said straight path portion of movement of said chain means to form a continuous abutment surface in abutting engagement with the adjacent side edge portion of said straight portions of said upper and lower continuous loop belt means.

4. The invention as defined in claim 3 and further comprising:

means for connecting each of said short length dam means to said upper continuous loop belt means; and means for moving oppositely located individual dam members away from each other so as to apply a force across the width of said upper continuous loop belt means to remove any wrinkles therefrom.

5. The invention as defined in claim 4 and further comprising:

means for disconnecting each of said short length dam means from said upper continuous loop belt means.

6. The invention as defined in claim 5 wherein:

said connecting means comprises a plurality of openings in said upper continuous loop belt means and an outwardly spring-urged piston on each of said short length dam means adapted to be engaged in said openings; and said disconnecting means comprises a rotatable member to depress said pistons.

7. The invention as defined in claim 1 and further comprising:

hydrostatic bearing means associated each of said arcuate guide means for supporting said belt means during movement about said arcuate guide means; and means associated with said hydrostatic bearing means to raise the temperature of at least one of said continuous loop belt means.

8. The invention as defined in claim 1 and further comprising:

belt splicing means for joining together adjacent ends of belt means while in position around said roll means and said arcuate guide means to form said continuous loop belt means; and belt tensioning means for adjusting the tension of at least one of said continuous loop belt means while in position around said roll means and said arcuate guide means.

9. The invention as defined in claim 1 and further comprising:

pivotal support means for one of said continuous loop belt means and the associated one of said arcuate guide means for enabling pivotal movement about the central axis of rotation of the associated one of said roll means between an operating position and a nonoperating position.

10. The invention as defined in claim 1 and wherein said cooling means comprises:

a high pressure plenum means for receiving a supply of cooling liquid having a relatively high pressure;

a plurality of individual elongated hollow housings extending from said high pressure plenum means toward the inner surface of said continuous loop belt means and having an opening in fluid communication with said high pressure plenum means;

means for mounting said individual elongated hollow housings for movement toward and away from said continuous loop belt means;

said individual elongated hollow housings being spaced apart in the direction of movement of said continuous loop belt means so as to form a plurality of rows;

each of said individual elongated hollow housings extending across the width of said continuous loop belt means;

means associated with said individual elongated hollow housings for permitting the flow of cooling fluid from said high pressure plenum through each of said housings and for discharging said cooling fluid against the inner surface of each of said continuous loop belt means;

means located between adjacent rows of said individual elongated hollow housings for collecting the heated fluid after contact with the inner surface of each of said continuous loop belt means;

means for discharging said collected heated fluid into a low pressure fluid plenum means; and conduit means for removing fluid from said low pressure fluid plenum means.

11. The invention as defined in claim 10 and further comprising:

means for controlling the rate of flow of heated fluid out of said low pressure plenum means to create a pressure differential to maintain contact of said individual elongated hollow housings on the associated one of said continuous loop belt means.

12. The invention as defined in claim 10 and further comprising:

flow restricting bar means within each of said individual elongated hollow housings for restricting the flow of fluid therethrough so as to create a force on each of said individual elongated hollow housings tending to move each of said individual elongated hollow housings toward said continuous loop belt means; and a plurality of spaced apart nozzle apertures in said flow restricting means for permitting the flow of cooling fluid therethrough.

13. The invention as defined in claim 1 and further comprising:

lubricating means between at least one of said continuous loop belt means and said continuous strip of cast aluminum sheet material for applying lubricant to said continuous strip of cast aluminum material; and said lubricating means located adjacent to, but spaced from, the nip between said upper and lower roll means.

14. The invention as defined in claim 1 and further comprising:

fluid pressure responsive means for applying a force to at least one of said straight portions of said continuous loop belt means to move said straight portions closer together during movement of said continuous loop belt means to compensate for shrinkage of said molten aluminum material during cooling.

15. The invention as defined in claim 14 and further comprising:

belt contact means for applying a vertical force to said dam means to move at least a portion of said dam means closer together in the same direction as said straight portions of said continuous loop belt means are moved toward one another to compensate for shrinkage of said molten aluminum material during cooling.

16. Apparatus for casting a continuous strip of aluminum sheet material having a rectangular cross-sectional configuration defined by an upper flat surface, a lower flat surface and opposed side edge surfaces comprising:

an upper continuous loop belt means having a lower elongated straight horizontal portion extending between spaced apart members;

a lower continuous loop belt means having an upper elongated straight horizontal portion extending between spaced apart members, and said upper and lower straight portions being spaced one from the other;

means for moving said upper and lower continuous loop belt means about horizontal axes;

dam means located adjacent opposite side edge portions of each of said continuous loop belt means for forming a rectangular cavity between at least a portion of said straight portions of said upper and lower continuous loop belt means;

each of said dam means comprising a pair of spaced apart sprocket means having vertical axes of rotation and movably supporting a continuous loop chain means for movement in a continuous path including an elongated straight horizontal path portion extending generally parallel to and adjacent to the side edge portions of said straight horizontal portions of said upper and lower continuous loop belt means;

each of said dam means further comprising a plurality of relatively short length individual dam members connected to and carried with said chain means for movement in adjacent abutting engagement with one another and along said straight horizontal path portion of movement of said chain means to form a continuous abutment surface in abutting engagement with the adjacent side edge portion of said straight horizontal portions of said upper and lower continuous loop belt means;

means for continuously feeding a supply of molten aluminum material between said upper and lower continuous loop belt means;

cooling means associated with each of said straight horizontal portions of said upper continuous loop belt means and said lower continuous loop belt means for cooling said molten aluminum material to form a continuous strip of cast aluminum sheet material; said cooling means for at least said upper continuous loop belt means comprises:

a high pressure plenum means for receiving a supply of cooling liquid having a relatively high pressure;

a plurality of individual elongated hollow housings extending from said high pressure plenum means toward the inner surface of said continuous loop belt means and having an opening in fluid communication with said high pressure plenum means;

means for mounting said individual elongated hollow housings for movement toward and away from said continuous loop belt means;

said individual elongated hollow housings being spaced apart in the direction of movement of said continuous loop belt means so as to form a plurality of rows;

each of said individual elongated hollow housings extending across the width of said continuous loop belt means;

means associated with said individual elongated hollow housings for permitting the flow of cooling fluid from said high pressure plenum through each of said housings and for discharging said cooling fluid against the inner surface of each of said continuous loop belt means;

means located between adjacent rows of said individual elongated hollow housings for collecting the heated fluid after contact with the inner surface of each of said continuous loop belt means;

a low pressure fluid plenum means for discharging said collected heated fluid into; and conduit means for removing fluid from said low pressure fluid plenum means.

17. The invention as defined in claim 16 and further comprising:

at least one of said spaced apart members comprising an arcuate guide means;

hydrostatic bearing means associated with said arcuate guide means for supporting at least one of said continuous loop belt means during movement about said arcuate guide means; and means associated with said hydrostatic bearing means to raise the temperature of said at least one of said continuous loop belt means.

18. The invention as defined in claim 16 and further comprising:

belt splicing means for joining together adjacent ends of at least one of said continuous loop belt means while in position around said spaced apart members to form said continuous loop belt means; and belt tensioning means for adjusting the tension of said at least one of said continuous loop belt means while in position around said spaced apart members.

19. The invention as defined in claim 16 and further comprising:

pivotal support means for at least one of said continuous loop belt means and the associated one of said arcuate guide means for enabling pivotal movement about an axis of rotation between an operating position and a non-operating position.

20. The invention as defined in claim 16 and further comprising:

flow restricting bar means for applying a force to said individual elongated hollow housings to move said straight portions of said continuous loop belt means closer together during movement of said continuous loop belt means to compensate for shrinkage of said molten aluminum material during cooling; and belt contact means for applying a vertical force to said individual dam devices to move at least a portion of said dam devices closer together in the same direction as said straight portions of said continuous loop belt means are moved toward one another to compensate for shrinkage of said molten aluminum material during cooling.

21. The method of continuous casting of a heated slab of metallic material comprising:

feeding molten metallic material from a source of molten metallic material into an elongated generally rectangular forming space defined by a pair of generally parallel horizontally extending continuous loop belt devices and a pair of continuous loop side dam devices;

causing uniform continuous synchronous movement of the belt devices and the dam devices in a horizontal direction from an inlet opening adjacent the source to a discharge opening to provide a generally rectangular length of metallic material therebetween which decreases in temperature from the inlet opening to the discharge opening;

continuously cooling the belt devices by applying a coolant to the belt devices at a first relatively high pressure and removing coolant at a second relatively low pressure to progressively remove heat from the metallic material during passage from the inlet opening to the outlet opening;

continuously maintaining surface contact between the belt devices and the upper and lower surfaces of the metallic material between the inlet opening and the outlet opening by applying a coolant pressure differential force on at least one of the belt devices to cause movement of the one belt device toward the other belt device;

continuously maintaining surface contact between the dam devices and the side surfaces of the metallic material during movement from the inlet opening to the outlet opening;

connecting one of the dam devices to at least one of the belt devices and positively outwardly displacing one of the dam devices to cause lateral stretching of the one of the belt devices to maintain continuous flat contact with a side surface of the metallic material;

directing the metallic material from the outlet opening to a pair of roller means located in juxtaposition to the outlet opening and causing the metallic material to pass between the pair of roller means; and driving the belt devices and the dam devices and the roller devices in synchronization from a common power source.

22. The method as defined in claim 21 and further comprising:

continuously applying relatively high pressure coolant to a coolant inlet chamber in communication with a series of coolant applying devices arranged along a material contacting portion of the one belt device opposite the rectangular forming space and in a direction transverse to the material contacting portions of the belt devices in contact with the upper and lower surfaces of the metallic material; and continuously removing the coolant at relatively low pressure from a series of coolant outlet chambers adjacent the coolant applying devices to cause a pressure differential to create a force on the portion of the one of the belt devices in contact with the upper surface of the metallic material which is directed toward the metallic material.

23. The method as defined in claim 21 and further comprising:

mounting the belt devices on the roller devices and driving the belt devices around the roller devices.

24. Apparatus for modification of an existing roll caster machine, having upper and lower vertically spaced driven roller devices rotatable about spaced parallel horizontal axes of rotation, for forming a slab of high temperature metallic material from molten metallic material which comprises:

a support frame mounted on one side of the existing roll caster machine adjacent the driven roller devices and extending horizontally outwardly away from the driven roller devices;

upper and lower belt guide devices mounted on said support frame in laterally outwardly spaced relationship to the driven roller devices and having vertically spaced horizontal axes parallel to the horizontal axes of rotation of the roller devices;

upper and lower continuously movable continuous endless loop belt devices operably associated with and supported by the roller devices and said belt guide devices;

each of said belt devices being movable in a loop path which includes an elongated horizontally extending path portion, an arcuate path portion extending about an associated one of the roller devices, an elongated inclined path portion, and an arcuate path portion extending about an associated one of said belt guide devices;

horizontally extending portions of said belt devices along said horizontally extending path portion being vertically spaced from one another to provide an elongated horizontally extending metal forming space therebetween defined by a downwardly facing lower belt surface on said upper belt device and an upwardly facing upper belt surface on said lower belt device and which has a metal inlet opening at one end adjacent said belt guide devices and a metal outlet opening at an opposite end between the upper and lower roller devices;

a pair of continuously movable laterally spaced endless loop side dam devices operably associated with said belt devices and being mounted on said support frame on rotatable support devices having vertical axes of rotation and located in laterally outwardly space relationship to the roller devices;

each of said side dam devices being movable in a loop path which includes an elongated horizontally extending dam forming path portion extending parallel to and of less length than said elongated horizontal path portion of said belt devices and forming side wall means along said metal forming space between said inlet opening and said outlet opening for preventing lateral outward movement of the metallic material, an arcuate path portion extending about a rotatable support device mounted on said support frame in laterally outwardly space relationship to the roller devices, an elongated horizontally extending return path portion of shorter length than said elongated horizontal path portion of said belt devices, and an arcuate path portion extending about a rotatable support device adjacent said inlet opening; and upper and lower belt supporting and cooling means mounted on said support frame between the roller devices and said inlet opening for supporting said horizontally extending portions of said belt devices along said elongated horizontally extending metal forming space.

25. The invention as defined in claim 24 and wherein:

said dam devices further comprising an endless loop chain member; and said rotatable support devices comprising sprocket wheel devices.

26. The invention as defined in claim 24 and wherein at least said upper belt supporting and cooling means comprising:

a plurality of coolant inlet chamber means for receiving relatively low temperature coolant at a relatively high pressure and delivering coolant into heat transfer contact with the associated one of said belt devices; and a plurality of coolant outlet chamber means for receiving relatively high temperature coolant at relatively low pressure after heat transfer contact with the associated one of said belt devices.

27. The invention as defined in claim 26 and wherein at least said upper belt supporting and cooling means further comprising:

elongated horizontally extending plenum means located opposite said elongated forming space for receiving and holding coolant therein; and a series of individual laterally spaced vertically extending inlet flow channel means engaging the upper belt device and being individually vertically adjustably movably mounted in said plenum means for vertical movement in response to pressure differential force therein to variably position the upper belt device relative to the metallic material in said elongated forming space.

28. The invention as defined in claim 27 and further comprising:

a plurality of nozzle means in each of said inlet flow channel means for directing relatively high pressure coolant onto said belt device and return flow channel means between said inlet flow channel means for removing coolant from said belt device.

29. Apparatus for solidifying molten metallic material such as aluminum and forming a continuous elongated solidified strip of metallic material having a rectangular cross-sectional configuration and including generally flat parallel upper and lower surfaces and generally flat parallel side edge surfaces, which comprises:

an upper continuous loop continuously movable belt means and a lower continuous loop continuously movable belt means for defining upper and lower surfaces of an elongated forming cavity means for forming the sheet material and extending between an inlet opening means for receiving molten metallic material and an outlet opening means for discharging the sheet material;

lowermost continuous belt drive and support means and uppermost continuous belt drive and support means having parallel horizontal rotational axes extending laterally across said forming cavity means transversely to the path of movement of the sheet material through said forming cavity means and defining a path of movement for said upper belt means including an elongated horizontal path portion extending along said forming cavity means whereat said upper belt means has a lower horizontal belt surface portion for contacting the upper surface of metallic material and an upper belt surface portion located thereabove and defining a path of movement for said lower belt means including an elongated horizontal path portion extending along said forming cavity means in generally parallel relationship to the elongated horizontal path portion of said upper belt means and whereat said lower belt means has an upper horizontal belt surface portion for contacting the lower surface of the metallic material and a lower belt surface portion located therebelow;

uppermost belt support means for slidably engaging and supporting the upper surface of said upper belt means opposite and along the length of said forming cavity means and lowermost belt support means for slidably engaging and supporting the lower surface of said lower belt means opposite and along the length of said forming cavity means;

coolant applying means associated with said uppermost belt support means and said lowermost belt support means for continuously applying coolant on the upper surface of said upper belt means and the lower surface of said lower belt means along an elongated forming and cooling zone;

pressure applying means operatively associated with said coolant applying means for continuously maintaining the lower surface of said upper belt means in contact with the upper surface of the sheet material while the upper surface of said lower belt means is in continuous contact with the lower surface of the sheet material in the forming cavity means;

a pair of continuous loop continuously movable side dam means for defining vertically extending opposite generally parallel side wall surfaces of said forming cavity means between said upper and lower belt means and having parallel vertical rotational axes;

each of said side dam means comprising a plurality of pivotally connected block members having flat inner side surfaces for forming a continuous side wall along each side of said forming cavity means and engaging the side edge portions of the sheet material;

connecting means for connecting each of said block members to said upper belt means during movement along said forming and cooling zone;

block actuating cam means associated with each of said side dam means for locating each of said block members in a side wall forming position whereat opposite lateral outward forces are applied on said upper belt means whereby said upper belt means is laterally tensioned to maintain a flat condition of engagement with the upper surface portion of the sheet material;

rotatable roller means downstream of said outlet opening means for providing a nip therebetween for receiving the continuous strip of metallic material from said outlet means; and drive means for causing synchronous rotation of said roller means and said belt means and said dam means.

30. The invention as defined in claim 29 and wherein said coolant applying means comprising:

an elongated plenum means having a length and a width approximately equal to the length and width of said forming cavity means and having a high pressure coolant chamber means for receiving relatively high pressure low temperature coolant fluid and having a low pressure coolant chamber means for receiving relatively low pressure high temperature coolant fluid.

31. The invention as defined in claim 30, and wherein said pressure applying means comprising:

a plurality of longitudinally spaced vertically extending rectangular shape coolant passage box means mounted in said plenum means in longitudinally spaced parallel side by side relationship along the length of said forming cavity means and extending laterally from side to side of said forming cavity means for providing coolant passage means between said high pressure low temperature coolant chamber means and said low pressure high temperature coolant chamber means.

32. The invention as defined in claim 31 and wherein:

each of said coolant passage box means comprising a pair of vertically extending laterally spaced side plate members and a pair of vertically extending end plate members defining a generally rectangular shape vertically extending fluid passage cavity therewithin having a generally rectangular shape coolant fluid outlet opening opposite and next adjacent the associated belt means with a flat horizontal peripheral surface extending about said outlet opening in generally parallel slidable abutting relationship to the associated belt means and an opposite generally rectangular shape coolant fluid inlet opening which is connected to said high pressure chamber means, a laterally extending plate member mounted in said fluid passage cavity opposite said coolant fluid outlet opening and having a plurality of laterally spaced venturi passages with discharge openings facing said outlet opening adjacent the associated belt means for directing coolant fluid onto the outer surface of the associated belt means along the forming cavity means.

33. The invention as defined in claim 32 and further comprising:

support plate means having longitudinally spaced laterally extending rectangular shape vertical slot means for vertically independently slidably supporting each of said box means relative to said plenum means and the associated belt means whereby each of said box means is independently vertically slidably adjustably displaceable in response to coolant fluid pressure differentials between said high pressure chamber and said low pressure chamber and variations in thickness of the metallic material in the forming cavity means and in location of the associated belt means.

34. The invention as defined in claim 33 and further comprising:

laterally extending rectangular shape coolant discharge passage means located between each of said box means and extending laterally from side to side of said forming cavity means and having a rectangular inlet opening next adjacent the associated belt means for receiving coolant fluid discharged from said coolant passage box means onto the associated belt means and for delivering the coolant fluid to said low pressure chamber; and positive pressure pump means for continuously delivering relatively high pressure low temperature coolant fluid to said high pressure chamber and negative pressure pump means for continuously removing relatively low pressure high temperature coolant from said low pressure chamber.

35. The invention as defined in claim 30 and wherein said dam means comprising:

endless loop link chain means having an elongated horizontal portion located laterally adjacent said forming cavity and travelling generally parallel to and in the same direction as said body of metallic material;

longitudinally spaced sprocket wheel means having vertical axes of rotation for supporting said chain means;

laterally extending block devices having one end portion fixedly connected to said chain means for support thereby and for movement therewith with the other end portion having vertically extending end surface means located inwardly of the edges of the belt means and extending between the belt means for contacting the side edge surface portions of the body of metallic material during movement through the forming cavity means and having horizontally extending upper and lower surface means for engaging the belt means and having oppositely facing vertically extending side surface means for abutting engagement with one another during movement along the forming cavity means; and said vertically extending end surface means of said block devices being aligned and coplanar with one another during movement along the forming cavity means and providing a continuous vertical wall means along the forming cavity means for holding the metallic material between said belt means.

36. The invention as defined in claim 35 and wherein each of said block devices further comprising:

an upper finger member attached to an upper portion of said chain means and extending laterally in cantilever fashion toward said belt means and terminating in a vertically downwardly extending flange portion;

a lower finger member attached to a lower portion of said chain means and extending laterally in cantilever fashion toward said belt means in parallel spaced relationship to said upper finger member and terminating in a vertically upwardly extending flange portion located in parallel offset abutting slidable relationship with said vertically downwardly extending flange portion; and a flat horizontal upper surface on said upper finger member for engaging the lower surface of said upper belt means and a flat horizontal lower surface on said lower finger member for engaging the upper surface of said lower belt means during movement along the forming cavity means whereby said finger members are resiliently deflectable toward and away from one another under loads applied thereto through said belt means.

* * * * *